United States Patent [19]

Jarrell, Jr.

[11] 3,945,047

[45] Mar. 23, 1976

[54] KNEE PROTECTOR

[76] Inventor: Richard P. Jarrell, Jr., P.O. Box 2039, Tyler, Tex. 75701

[22] Filed: Dec. 19, 1974

[21] Appl. No.: 534,361

[52] U.S. Cl. ..... 2/24
[51] Int. Cl.[2] ..... A41D 13/06
[58] Field of Search ..... 2/22, 24, 16, 3 R, 2; 128/80 C

[56] References Cited

UNITED STATES PATENTS

| | | | |
|---|---|---|---|
| 1,117,168 | 11/1914 | Crowley | 2/24 |
| 2,587,166 | 2/1952 | Jovick | 128/80 C |
| 3,350,719 | 11/1967 | McClure, Jr. | 2/22 |
| 3,487,417 | 12/1969 | Morgan | 2/3 R |
| 3,551,912 | 1/1971 | Viglione | 2/24 |
| 3,742,517 | 7/1973 | Bednarczuk | 2/22 |

*Primary Examiner*—Werner H. Schroeder
*Assistant Examiner*—Peter Nerbun

[57] ABSTRACT

A knee protector for athletes features a resilient body portion having interconnected internal fluid-filled chambers for absorbing straight on or lateral impact forces on the knee joint and for distributing these forces in a most advantageous manner. An internal brace structure reinforces the resilient body portion and includes articulated brace sections within the critical side shock-absorbing chambers to allow natural knee flexure but to strongly resist lateral bending. Mobility and reasonable comfort are not sacrificed.

7 Claims, 13 Drawing Figures

KNEE PROTECTOR

BACKGROUND OF THE INVENTION

It is widely known that a critical need exists for better protection of the knees of athletes, particularly football players. In the professional football ranks alone, knee injuries continue to end or shorten the careers of some of the highest paid athletes, thereby causing great economic loss to these individuals and their employers, not to speak of personal suffering and the sometimes crippling results of such injuries. Serious knee surgery on football players is now an every day matter in the hospitals of the country.

The problem has been recognized for quite some time and has been unsuccessfully dealt with by the use of various forms of knee padding, elastic knee bands, and the like, and in some instances very awkward and inefficient brace structures which not only tend to immobilize the knee and limit its use but are very dangerous to others coming in bodily contact with the wearer of the brace. Such prior art devices are heavy and awkward as well as dangerous.

Up to the present time, there is no known knee protector which comes close to satisfying the desires of the athletes or the orthopedic docotrs who care for them. In short, the technology in the design and manufacturing of the protectors has not kept abreast of the up-to-date knowledge concerning knee injuries, the functioning of the knee joint and its inherent weaknesses, particularly against lateral forces or impacts. The physicians and the athletes involved may have a vague idea of what they need to protect the knee against these injuries, but thus far no protector has been devised or been made available to do the job. Accordingly, it is the object of the invention to provide such a protector for the knee which is based on scientific analysis of the injuryprone knee joint, its weaknesses and strengths, and the need for adequate protection of the joint with minimum loss of mobility and comfort. It is known that the knee could be perfectly protected from injury by enclosing it in a rigid cast to completely immobilize it but such protection would obviously be of no benefit to athletes, such as football players, whose success in the sport depends almost entirely on speed and mobility.

SUMMARY OF THE INVENTION

With the above problem and objective in mind, the invention provides a lightweight and reasonably comfortable knee protector which allows mobility of the knee in the normal direction of flexure of that joint while strongly resisting lateral bending which the natural joint is not capable of sustaining to any significant degree. A strong, yet lightweight, internal brace structure includes side vertical link sections which are highly resistant to lateral bending while allowing unrestricted bending of the knee in the normal or natural direction. Additionally, this brace structure is molded inside of and integrated with a tough protector body portion of relatively firm rubber-like material which is inherently impact and abrasion-resistant while possessing enough flexibility to allow freedom of movement of the knee joint. This body portion has a lining of elastic fabric or some similar soft material to promote comfort and eliminate skin abrasion.

A key feature of the invention resides in the provision of intercommunicating frontal and side compartments in the body portion of the protector which are filled with a cushioning fluid which may be gas or liquid, such as water containing an antifreeze additive. In some cases, a foam rubber-like padding may also be utilized in the fluid-filled cushioning or shock absorbing compartments. In response to impact against the knee at either side protected by one of these compartments, some of the fluid from this compartment, while absorbing the shock forces, will flow through communicating passages leading to the other compartments with the result that the knee will instantly receive additional support at the side opposite to the blow or impact, plus the fact that there will be a net tightening effect of the entire protector around the knee joint due to the resistance of the fluid to compression. After the impact force has been absorbed by the protector, the internal fluid will automatically return to the normal state in which it fills the three compartments in a balanced manner. The critical articulated side braces extend directly through the side fluid compartments so as to be positioned for maximum resistance to lateral bending and to receive a lubricating action from the fluid.

Other features and advantages of the invention will become apparent during the course of the following description.

BRIEF DESCRIPTION OF DRAWING FIGURES

DETAILED DESCRIPTION

Figure 8:
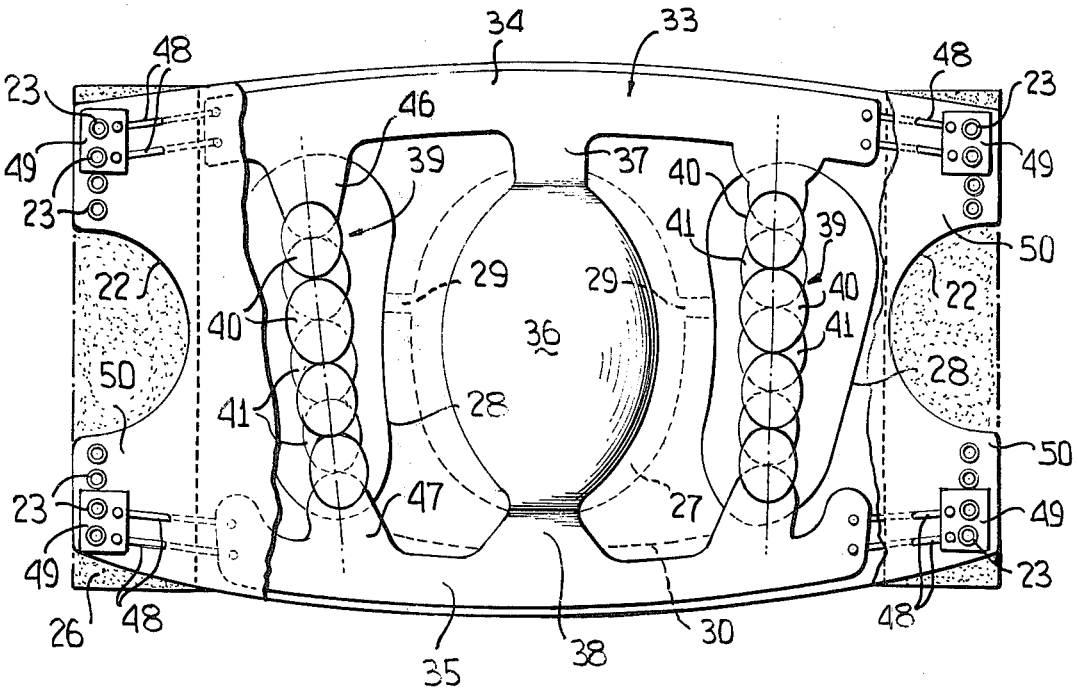
FIG. 8 is a front elevational view of the protector in an open or flattened condition, with parts broken away to show the internal brace means in relation to the other structure of the invention.
Figure 9:
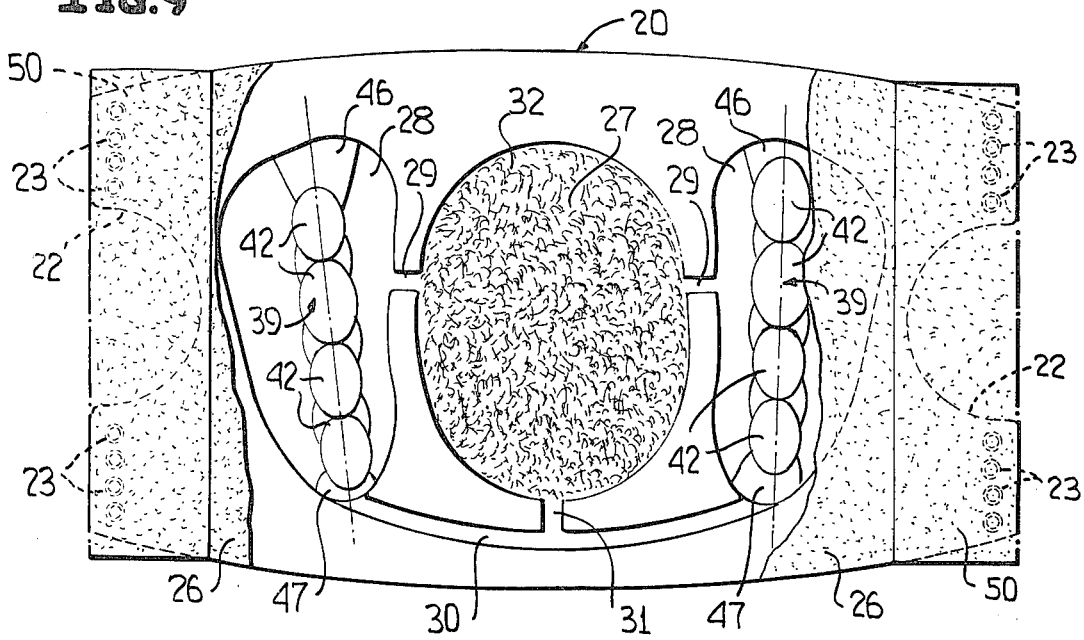
FIG. 9 is a similar view of the interior side of the device, partly broken away, to show the fluid compartments and interconnecting passages.
Figure 10:
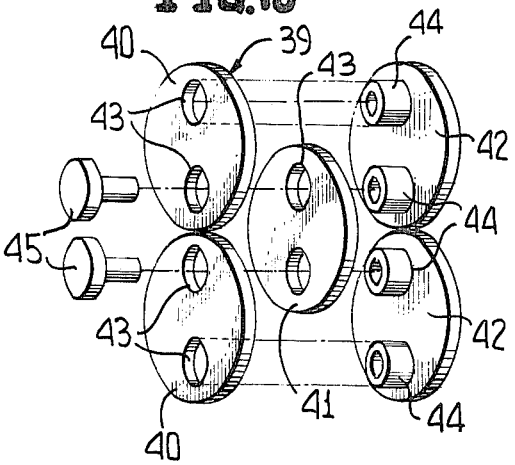
FIG. 10 is an exploded perspective view of an articulated brace.
Figure 11:
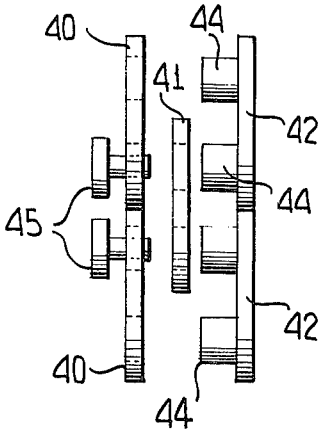
FIG. 11 is an exploded side elevation of the same.
Figure 12:
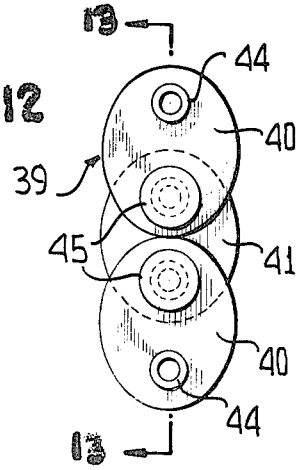
FIG. 12 is an assembled elevational view of a portion of the brace.
Figure 13:
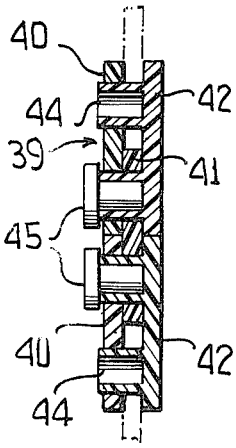
FIG. 13 is a vertical section taken on line 13-13 of FIG. 12.

Referring to the drawings in detail wherein like numerals designate like parts, the numeral 20 designates a knee protector body portion formed of tough natural or synthetic rubber or rubber-like material. The body portion 20 is shock and abrasion resistant by nature and yet sufficiently flexible to allow the necessary normal knee movement in a comparatively unrestricted manner. The body portion 20 may be molded so that it will assume the generally tubular limb encompassing formation shown in FIGS. 1 to 4 while in a relaxed state, FIGS. 8 and 9 showing the structure in an unnatural flattened state for illustration purposes only.

Figure 1:
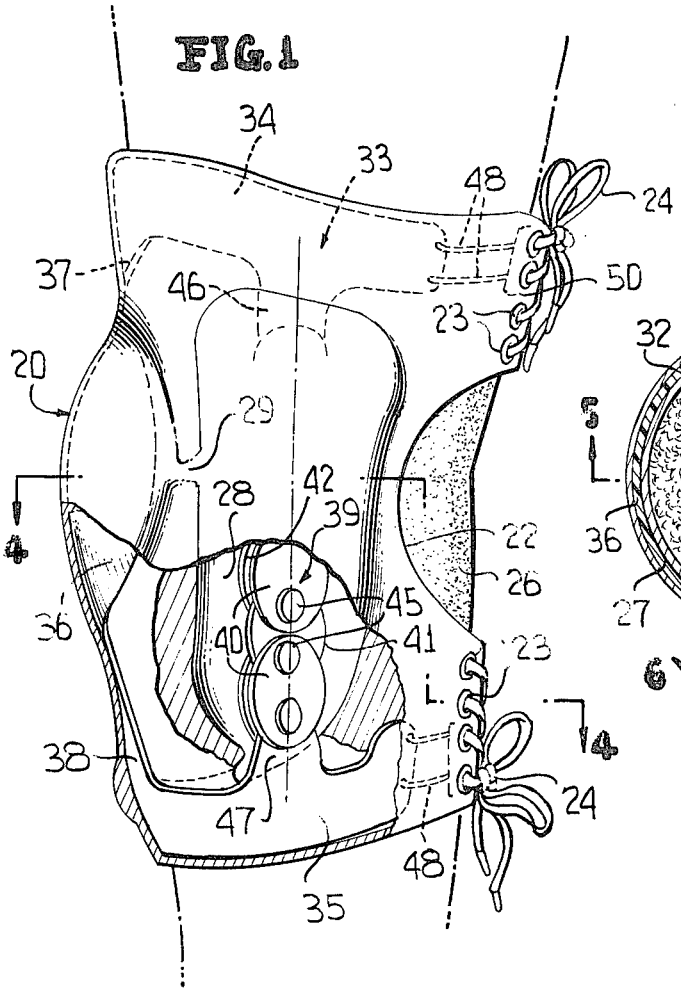
FIG. 1 is a side elevational view, partly broken away and partly in section, showing a knee protector embodying the invention applied to the knee of a user.

The generally tubular body portion 20 is of sufficient length to encompass the entire knee joint and extend somewhat above and below the knee, FIG. 1. It extends continuously around the knee from side-to-side thereof and across the front of the knee and is divided centrally at its rear side as indicated at 21 above and below a relatively large centrally located rear opening 22 in the body portion 20. Lacing eyelets 23 are provided at the top and bottom rear separated extremities of the body portion 20 enabling the device to be drawn snugly around the leg above and below the knee by suitable lacing 24. In general, the body portion 20 is molded in such a manner that it will conform to the natural contours of the leg adjacent to the knee joint.

Figure 4:
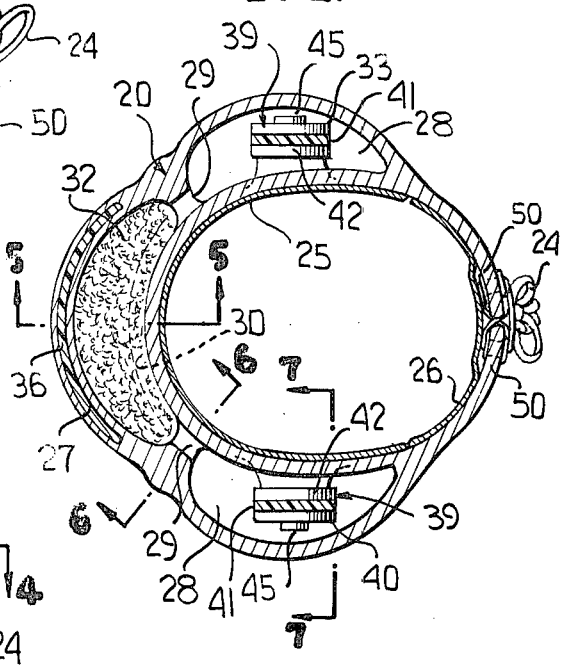
FIG. 4 is a horizontal section taken on line 4—4 of FIG. 1.
Figure 2:
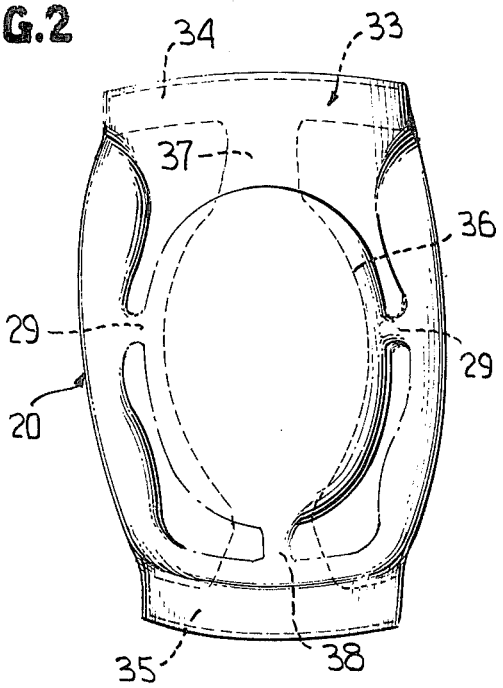
FIG. 2 is a front elevation of the knee protector.
Figure 3:
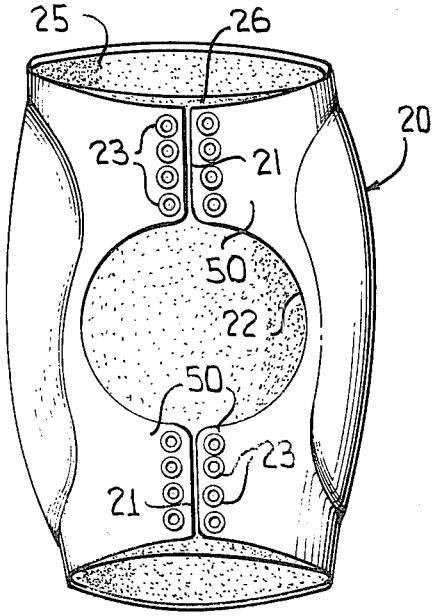
FIG. 3 is a rear elevation thereof.
Figure 5:
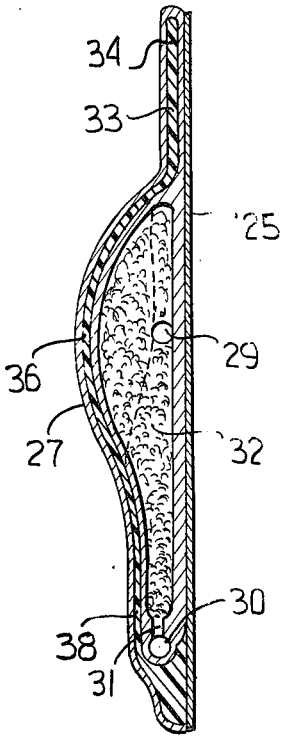
FIG. 5 is a fragmentary vertical section taken on line 5—5 of FIG. 4.
Figure 6:
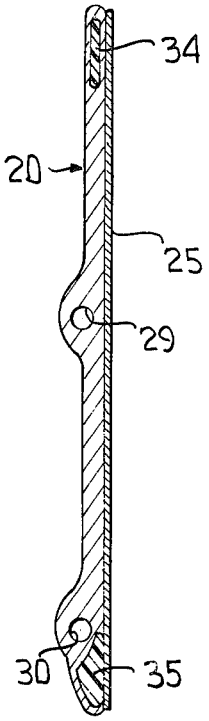
FIG. 6 is a similar section taken on line 6—6 of FIG. 4.
Figure 7:
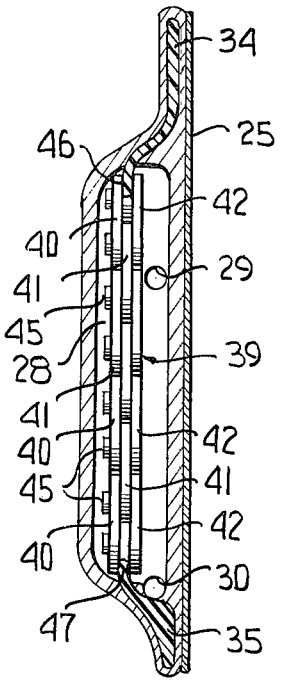
FIG. 7 is a similar section taken on line 7—7 of FIG. 4.

Preferably, as shown in FIG. 4, the interior surface of the rubber-like body portion has a soft cloth lining 25 suitably attached thereto including a preferably elastic rear portion 26 extending across the back of the knee adjacent the rear opening 22. One purpose of this lining is to resist irritation of the skin by any rubbing against the protector which may take place and also the lining tends to make the device fit more snugly particularly where the lining portion 26 is elastic.

The body portion 20 is formed to provide three distinct internal fluid-holding compartments 27 and 28, the former compartment 27 spanning the knee cap region and the two side compartments 28 covering the two sides of the joint and being elongated vertically, as shown in the drawings. These compartments are closed except for a pair of upper interconnecting restricted passages 29 near the vertical centers of the three fluid compartments, FIG. 9, and a bottom interconnecting passage 30 between the two side compartments 28, having a center branch 31 leading to the bottom of the frontal fluid compartment 27. By this means, the three fluid compartments 27 and 28 are in direct communication through restricted passages and are part of a closed fluid system. This system may be filled with suitable liquid, such as water, or a gas in some cases. If water is employed, an antifreeze additive may be used for winter usage. Optionally, the frontal compartment 27 or all three compartments, in some instances, may additionally contain compressible rubber or plastic foam material 32 for added shock-absorbency and impact-resistance. However, in terms of cushioning ability and shock-absorbency, the device works quite efficiently with the compartments 27 and 28 filled with fluid only.

Because of the intercommunication between the three fluid filled compartments, when the knee receives a blow from the front or from either side, the adjacent fluid compartment will be compressed and will offer initial resistance to shock or impact and simultaneously some of the fluid from this compartment will be forced through the interconnecting passages into the other fluid compartments, which will have to expand somewhat to accept the additional fluid. In this way, greater tension will be exerted on the knee at the opposite side to that which receives the actual blow or impact, assuming that this blow was directed against one side of the leg adjacent to the knee and received by one of the side cushioning or shock absorbing compartments 28. Similarly, if the knee is struck at the front, the front compartment 27 will absorb the main blow and cushion it and some fluid will be forced momentarily into both side compartments 28, whereby the entire body portion 20 will, at the critical moment, exhibit a substantially increased holding or supporting force on the joint.

Following the blow causing compression of the one fluid compartment, the device will automatically return gradually to the normal or balanced condition shown in FIG. 4 with the internal fluid being equalized in the three intercommunicating chambers or compartments.

In addition to the above unique protective mode of operation, the device also has an efficient lightweight internal structural brace which adds substantial increased protection to the knee in vital areas at the two sides and knee cap. This brace, designated in its entirety by the numeral 33, is preferably formed of rigid plastic of the type commonly used in football helmets or shoulder pads. In some cases, stainless steel or the like could be utilized in lieu of hard plastic. The integral brace 33 comprises a top band or partial ring 34 which encompasses the front and opposite sides of the leg as illustrated in FIG. 1 and a similar lower end band 35, or partial ring, forming a part of the integral brace. The bands 34 and 35 are immediately above and below the knee joint. They are integrally joined at the front of the knee by a concave knee cap covering shell or plate 36 immediately ahead of forward fluid compartment 27. The sections 34, 35 and 36 are connected at the front of the brace by top and bottom short central vertically extending portions 37 and 38. The entire integral brace 33 is comparable in its stiffness to a sturdy spring steel element but still has a certain degree of yield so as not to destroy the vital flexibility of the protector.

The brace 33 further includes at its two sides, directly adjacent to the sides of the knee, vertical articulated brace sections 39 which extend directly into and through the two side fluid chambers 28 centrally. Each of these articulated sections 39, FIGS. 10 through 13, is composed of plural alternately staggered plate links 40 and 41 and a like plurality of connector links 42 on the sides of intervening links 41 remotely from the links 40. Both the links 40 and 41 have dual vertically spaced openings 43 for the reception of projecting sleeve connectors 44 or pivot elements on the plate links 42. Coacting headed pin fasteners 45 are received within the bores of elements 44 to complete the construction of the articulated brace section which is highly flexible in a direction across the axes of pivot elements 44 and 45 and highly rigid or resistant to bending in a right angular direction.

The top and bottommost plate links 40 and 42 of each articulated brace section 39 are pivotally joined to downwardly and upwardly extending plate-like terminals 46 and 47 of the two bands 35 and 34 which complete the formation of the side articulated brace sections. As should now be apparent, the brace sections 39 are located on the device to allow free bending of the knee in the normal plane fore and aft while serving as rigid braces to resist bending of the knee joint laterally due to a blow on either side of the knee, which the knee cannot withstand readily, as is well known. The brace 33 thus augments the protective action of the rubber-like body portion 20 with its internal shock-absorbing fluid-filled compartments 27 and 28 having the described ability to reinforce one another by fluid flow following impact to strengthen the protector at the side opposite to the point of impact.

To further strengthen the protector, tough cords 48 of nylon or equivalent material interconnect the ends of brace bands 34 and 35 with plate elements 49, FIG. 8, embedded in the top and bottom rear extensions 50 having the eyelets 23 for lacing. The elements 49 are firmly secured to at least the upper pair of eyelets 23 of each set of eyelets or the lower pair, as depicted near the top and bottom of FIG. 8. By virtue of this arrangement, when the laces 24 are pulled up tight, the entire structure of the body portion 20 and interior brace 33 will be drawn tightly around the leg without relative slipping or stretching movements between the parts of the structure.

It should be noted that, in cases where there may be less need for impact protection, the internal brace unit 33 could be omitted from the invention, and only the fluid-filled rubber-like body portion 20 would be employed with its described mode of operation.

Another point or feature which should be noted is the fact that fluid may be introduced into the chambers 27 and 28 from the outside by a hypodermic needle or similar implement, and the body portion may be repaired when needed by patching, much like the patching of an automobile tire.

It should also be noted that, in the operation of the closed fluid system following impact against one of the compartments 27 or 28, the fluid therein passes slowly into the other compartments by virtue of the restricting effect of the ports or passages 29, 30 and 31. This retarded action is desirable as it is the purpose of each fluid-filled compartment to first cushion the impact and then follow up by sending some of its fluid to the opposite side compartment to strengthen the opposite side of the protector and thus further resist lateral bending of the knee joint.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A knee protector comprising a body portion of rubber-like material of roughly tubular formation and adapted to be applied to the leg of a user substantially in surrounding relation to the knee joint, said body portion having an internal front fluid filled cushioning compartment and two side fluid-filled cushioning compartments adjacent the knee joint, said front compartment being disposed to overlie and cover the knee cap and the two side compartments being disposed to overlie and cover the two lateral sides of the knee joint, interconnecting flow passage means for fluid formed in the body portion communicating the front compartment with the two side compartments and the two side compartments with each other, whereby in response to impact against the protector adjacent one fluid compartment such compartment will be compressed and will force fluid therefrom through said flow passage means and into other compartments of the body portion; and relatively rigid mechanical bracing means comprising arcuate top and bottom leg embracing portions embedded in the material of the body portion above and below the cushioning compartments therein, and articulated side sections extending between and connecting said top and bottom portions formed of a plurality of hingedly connected plate members extending vertically through the side compartments of the body member, said plates being resistant to lateral bending and said hinged connections providing high flexibility in the normal direction of bending of the knee.

2. The structure of claim 1, and a mechanical knee cap brace integrated with the rubber-like body portion comprising a concavo-convex plate-like part exteriorly overlying the front compartment at the knee cap and connected at its upper and lower ends to the top and bottom leg embracing members of said bracing means.

3. The structure of claim 2, wherein said articulated brace sections extending substantially vertically through said side fluid compartments are completely enclosed and movable within the fluid within said compartments, and said front compartment is also filled with foam-like padding.

4. The structure of claim 2, wherein the body portion of the protector is divided at its rear side behind the knee and has lacing terminals extending along the division line at least at the top and bottom of the body portion.

5. The structure of claim 2, wherein said mechanical brace means is formed of substantially rigid plastic possessing limited flexibility.

6. The structure of claim 4, and high tension connector means within the body portion interconnecting said lacing terminals with the adjacent ends of the top and bottom leg embracing portions of said mechanical brace.

7. The structure of claim 1, and an interior cloth-like lining for said body portion including a central rear section adapted to embrace the back of the knee, the body portion having an opening at the back of the knee and being divided vertically above and below said opening and having separable fastener means on its divided terminals.

* * * * *